US006589371B1

(12) United States Patent
Kaibyshev et al.

(10) Patent No.: US 6,589,371 B1
(45) Date of Patent: Jul. 8, 2003

(54) METHOD OF PROCESSING TITANIUM METAL ALLOYS

(75) Inventors: Oskar Akramovich Kaibyshev, Ufa (RU); Gennady Alekseevich Salischev, Ufa (RU); Rafael Manurovich Galeyev, Ufa (RU); Ramil Yavatovich Lutfullin, Ufa (RU); Oleg Rayazovich Valiakhmetov, Ufa (RU)

(73) Assignees: General Electric Company, Schenectady, NY (US); Institute of Metals Superplasticity Problems of the Russian Academy of Sciences, Ufa (RU)

( * ) Notice: Subject to any disclaimer, the term of this patent is extended or adjusted under 35 U.S.C. 154(b) by 0 days.

(21) Appl. No.: 09/297,111

(22) Filed: Apr. 23, 1999

Related U.S. Application Data

(63) Continuation of application No. PCT/US97/18642, filed on Oct. 17, 1997.

(30) Foreign Application Priority Data

Oct. 18, 1996 (RU) ..... 96120958

(51) Int. Cl.[7] ..... C21D 11/00

(52) U.S. Cl. ..... 148/504; 148/670; 148/671; 148/421

(58) Field of Search ..... 148/504, 670, 148/671, 421

(56) References Cited

U.S. PATENT DOCUMENTS 4,581,077 A * 4/1986 Sakuyama et al. ..... 148/670
4,902,355 A 2/1990 Jaffe et al. ..... 148/11.5 F
5,264,055 A 11/1993 Champin et al. ..... 148/671
5,304,263 A 4/1994 Champin et al. ..... 148/671

OTHER PUBLICATIONS

Gamma Titanium Aluminides, Proc. Symp., Jun. 1995, pp. 595–602, G. Salischev et al, Dynamic Recrystallization and Super plasticity in Tial.

O.R. Valiakhmetov et al, Mechanical Properties of the Titanuim Alloy TT8 With Submicro–Crystalline Structure, Physics of Metals and Metallography, vol. 70, No. 4 1990, p. 198–200.

G.A. Salishchev et al, Formation of Submicroorystalline Structure in the Titantium Alloy VT8. and its Influence on Mechanical Properties, J. Material Sci., vol. 28 1993 p. 2898–2902.

D. Kaibyshev et al, Formation of Submicrocrystaline Structure in Materials During Dynamic Recrystallization, Materials Science Forum, vol. 113–115, 1993 P. 423–428.

* cited by examiner

*Primary Examiner*—John Sheehan
*Assistant Examiner*—Andrew L. Oltmans
(74) *Attorney, Agent, or Firm*—Jay L. Chaskin

(57) ABSTRACT

A method of manufacturing titanium alloys in large-section semi-finished product form with controlled microstructure in micrograin and subcrystalline states of aggregation, with reduced metallographic texture, is achieved with the desired combination of mechanical properties in the titanium alloy product.

18 Claims, 9 Drawing Sheets

METHOD OF PROCESSING TITANIUM METAL ALLOYS

This is a continuation application of International Application No. PCT/US97/18642 filed Oct. 17, 1997.

FIELD OF THE INVENTION

The given invention is related to the field of metallurgy. More particularly, the invention relates to methods of preparing titanium alloys working with the lamellar structure. This invention is useful for making large semi-finished parts by working them with pressure to subsequently make finished products of different shapes. The large section parts may be utilized in aerospace industries, for example, disks, jet-engine blades, and airframe structures.

BACKGROUND OF THE INVENTION

Titanium alloys are hard to deform materials. Titanium alloys with microstructures of fine grains have better plasticity than those with coarse grains. The need to increase the plasticity of titanium alloys results in the need to develop methods of making titanium alloy microstructures with grain sizes less than about 10 micrometers. Such a microstructure can be obtained in small section semi-finished products, for example, in hot-rolled bars with diameters not exceeding 60 millimeters. The microstructure of semi-finished products is coarser in large section sizes. Most semi-finished products have a coarse lamellar microstructure with crystallographic and metallographic texture having a grain size larger than 100 micrometers.

Grain coarsening in titanium alloys results in unsatisfactory mechanical properties. A noteworthy feature of a coarse-grained lamellar microstructure is that it has a high degree of structural heterogeneity which results in combination of low tensile strength and lower plasticity, low fatigue properties, and significant scatter in mechanical properties. It is not possible to make make the coarse-grain lamellar microstructure into a fine-grain microstructure by heat treatment. On the otherhand, it is possible to coarsen fine-grain microstructure of titanium alloys at the temperatures of single beta phase existence and at the temperatures in the two phase alpha and beta regions.

Producing a homogeneous fine-grain microstructure in titanium alloys would improve the technological properties during the thermomechanical processing due to reduction of stresses required for plastic flow. Also, the superior mechanical properties of semi-finished products would be provided, as well as superior mechanical properties after heat treatment.

It is known that it is possible to obtain a fine-grain microstructure in titanium alloys after rapid cooling from the molten state. Because of the low heat and temperature conductivity of titanium alloys, it is impossible to use this method for industrial titanium ingots made in accordance with the modern technologies. This method is used in powder metallurgy.

It is also known that in powder metallurgy it is possible to obtain a fine-grain microstructure due to the use of fine powder (about 50–100 micrometers) and a high solidification rate. One of the most significant disadvantages of powder metallurgy is the need to consolidate the powder. This limits the dimensions and size of the products, increases time, labor input, and the cost of the semi-finished product. Also, there is significant grain growth during consolidation due to the high temperatures of consolidation. Impurities from the powder particle surfaces reduce properties in comparison with the alloys made in accordance with traditional methods.

The conventional method of working titanium alloys, such as gatorizing, is known. It includes initial working at temperatures about 56° C. lower than the recrystallization temperature, with subsequent heating and working (pressing/forging) of the alloys at the recrystallization temperature. The recrystallization temperature is the temperature that the metal starts to deform. The formation of fine-grain microstructure is achieved by means of recrystallization of a work-hardened material during subsequent working. The above-mentioned method of microstructure refinement can be applied mainly for semi-finished products which had been previously intensely hot-worked in the alpha and beta regions. An elongated microstructure and strong texture are formed in these worked titanium alloys, which lead to significant allotropy of the mechanical properties.

Thus, the prior art shows that the methods to manufacture large section titanium semi-finished products with uniform fine-grain microstructure and mechanical properties have not been achieved. There is a need to have methods to process titanium alloys that have substantially homogeneous fine-grain microstructure and mechanical properties throughout the workpiece.

BRIEF DESCRIPTION OF THE INVENTION

This invention satisfies the above-mentioned need by providing a method of manufacturing titanium alloys in large-section semi-finished product form with controlled microstructure in microgram and subcrystalline states of aggregation, with reduced metallographic texture, to achieve the desired combination of mechanical properties in the titanium alloy product.

In one embodiment of the invention there is a method for preparing a titanium alloy article, distinguished by having a substantially controlled homogeneous fine grain microstructure, comprising the steps of: (1) starting with a titanium alloy article having an initial grain size ($d_o$); (2) selecting a final homogeneous fine grain size ($d_K$) to be achieved in the titanium alloy article; (3) plotting a curve of the relationship between a recrystallized grain size (d) for the titanium alloy on the y-axis versus a strain temperature (T) for said alloy on the x-axis, between a range of 400° C. and a temperature of complete polymorphous transformation ($T_{CPT}$), in accordance with the relationship d=f(T); (4) locating an area T* on the strain temperature axis to divide the temperature axis into two zones comprising a first zone 400° C. to T*, and a second zone T* to $T_{CPT}$, where said. T* is located by first calculating a corresponding recrystallization grain size (d*) on the y-axis, where d* is logarithmically related to the initial grain size do; (5) further locating on the curve the final grain size ($d_K$) on the y-axis and then a corresponding strain temperature ($T_K$) on the x-axis; (6) determining the heating and deforming stage or stages to process the article based on $T_K$, where for $T_{CPT}>T_K>T^*$, there is at least one heat and deforming stage to obtain the final grain size $d_K$, and where $T_K<T^*$, there are at least two heat and deforming stages where each heat and deforming stage occurs for a sufficient amount of time to reduce the grain size of the titanium alloy article [about 2 to 10 times] until the final grain size $d_K$ is obtained; (7) then heating and deforming the titanium alloy article in accordance with the determined number of heat and deforming stages to achieve $d_K$, where each heat and deforming stage has at least one heating and deforming step and one cooling step, where said heat and deforming stage occurs for a sufficient period of time to reduce the grain size of the titanium alloy article, and where the deformation of the titanium alloy article is in a substantially controlled manner during each heat and deforming stage at a rate of strain to achieve the desired grain size of the heat and deforming stage, where the true strain during the deformation is greater than or equal to 0.6 for each heat and deforming stage, and where said subsequent cooling is controlled at a temperature below the heat and deforming stage temperature at a cooling rate for substantially maintaining the reduced grain size obtained during the heat and deforming stage; and (8) repeating step (7) until the final substantially controlled homogeneous grain size $d_K$ is obtained in the article having substantially homogeneous mechanical properties.

The final fine grain size is less than or equal to about 15 micrometers. A fine grain size is defined as grains having less than or equal to about 15 micrometers diameter. More narrowly, a preferred fine grain is less than 5 micrometers diameter. Conversely, large grains are greater than 15 micrometers diameter. When there is at least two heat and deforming stages, each heat and deforming stage occurs for a sufficient amount of time to reduce the grain size of the titanium alloy article about 2 to 10 times until the final grain size, $d_K$, is obtained.

Another embodiment of the invention is a method of making a substantially controlled homogeneous fine grain microstructure in a titanium alloy article, comprising the steps of: heating and deforming at a predetermined heat and deforming stage temperature at or below a temperature of complete polymorphous transformation where the titanium alloy article has sufficient ductility and a starting grain size, said heat and deforming stage contains at least one heat and deforming step and at least one cooling step, and where said heat and deforming stage is for a sufficient amount of time to reduce the grain size from the starting grain size at the beginning of the heat and deforming stage to a reduced grain size at the end of the heat and deforming stage, where deforming the titanium alloy is in a controlled manner at a rate of strain to achieve the desired grain size of the heat and deforming stage, where the true strain during the deformation is greater than or equal to 0.6 for each heat and deforming stage and where the cooling step is performed after the heat and deforming step at a temperature below the heat and deforming stage temperature, in a controlled manner at a cooling rate to substantially maintain the reduced grain size obtained during the heat and deforming stage; and continuing to heat and deform then cool the titanium alloy article, at lower heat and deforming stage temperatures than the previous heat and deforming stage temperature, so a reduction of grain size is achieved in subsequent heat and deforming stages until a final controlled grain size with controlled mechanical properties is obtained in the titanium alloy article.

Still another embodiment of the invention provides methods of making large section semi-finished products without any limits in size and shape. In this invention, semi-finished product is defined as a material form, such as a bar, plate or billet, that is supplied for further processing. For example, a bar is a semi-finished product from which bolts, pins, etc., are manufactured. As another example, a billet is a semi-finished product from which aircraft disk forgings are made. The term large section is relative to the part being semi-finished. For instance, a titanium alloy billet greater than about 4 inches could be termed large, disk forgings greater than about 30 inches diameter or 6 inches thickness are large. Also, when referring to titanium intermetallic based compositions such as those based on $Ti_3Al$ (alpha 2), $Ti_2AlNb$ (orthorhombic), or TiAl (gamma), a large section would be much smaller, since intermetallic materials are typically harder to process. A gamma or orthorhombic forging greater than about 12 inches could be termed large. The term Lamellar structure refers to alpha phase (hexagonal crystal structure) titanium arranged in plates. Often, plates share a common crystallographic orientation and are termed a "colony".

DESCRIPTION OF THE INVENTION

Figure 1:
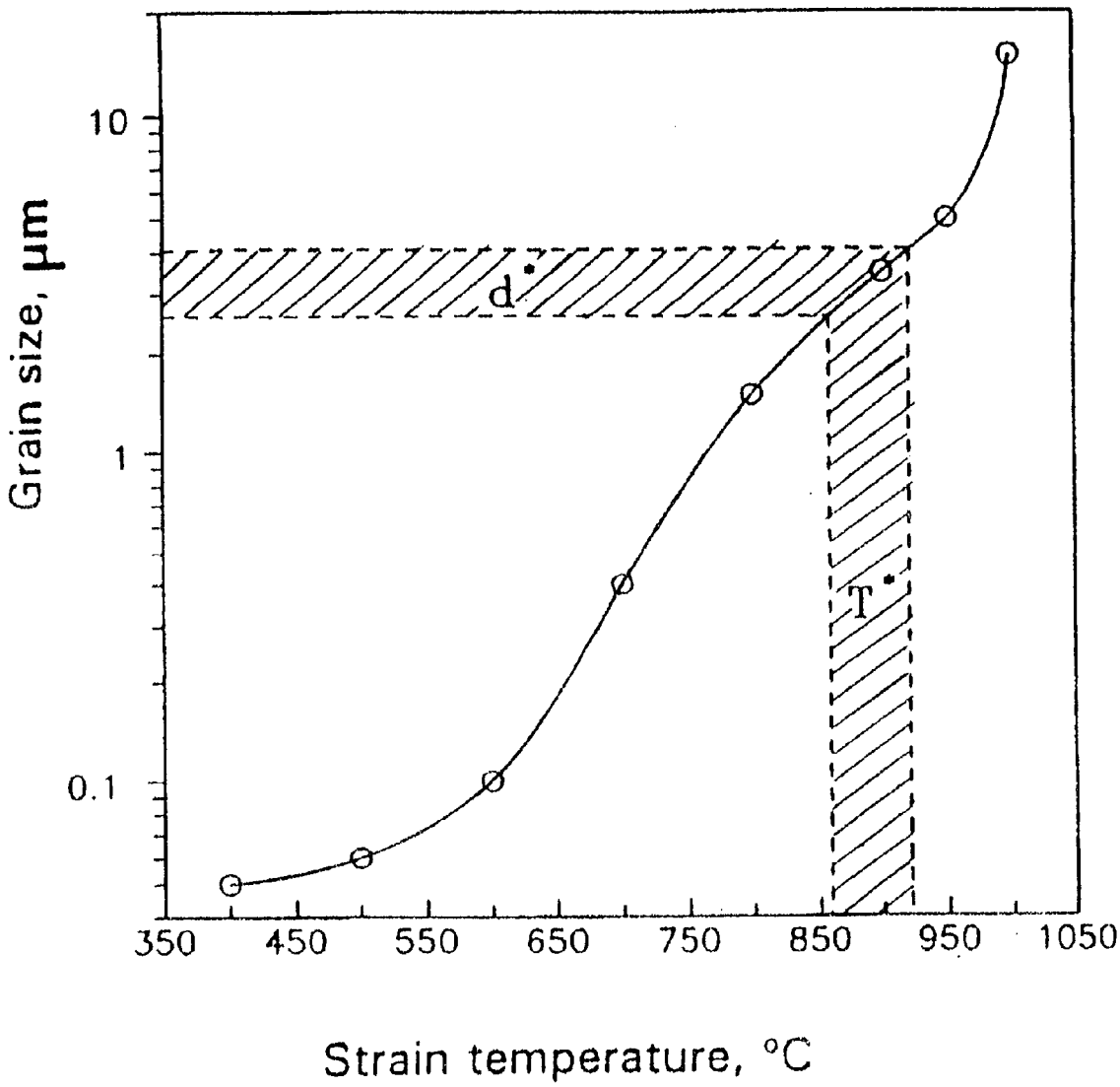
FIG. 1—Relation of recrystallized grain size to strain temperature for titanium alloy BT8 at strain rate of 7–10–4 $sec^{-1}$ and at e=0.6 strain. The d* and T* areas (at $d_o$=1000 mm) are shaded.

The invention is achieved by methods of working titanium alloys which include heating of the starting stock or ingot and its deformation inside preheated forging tools. A distinguishing feature of the method is that the temperature range for thermomechanical processing is extended to the range of about 400° C. to $T_{CPT}$, where $T_{CPT}$ is the temperature of the complete polymorphous transformation, also called the beta transus. The temperature of complete polymorphous transformation (beta transus) is the temperature at which all alpha phase in the titanium alloy has transformed to beta phase. Before working or deforming the titanium alloy article, the relation of recrystallized grain size to strain temperature, d=f(T), in the specified temperature range must be determined for the material of the stock. The specified temperature range (400° C. to $T_{CPT}$) is then divided into two zones. The boundary between those zones is set at the temperature T* at which the grain size is d*. The grain size d* can be determined from the ratio $Ig(d_o/d^*)$ equals about 2.4 to about 2.6 for the alloys with the beta stabilization coefficient $K_B$<about 1.4 and $Ig(d_o/d^*)$ equals about 1.8 to about 2 for the alloys with $K_B \geqq 1.4$, where $d_o$ is the grain size of the initial stock or ingot. The strain temperature $T_K$ is determined from the relationship d=f(T) accordingly to the required final grain size. Depending on within which of the two ranges of temperature (T* to $T_{CPT}$ or 400° C. to T*) is located $T_K$, the deformation can be done in one or several stages. The number of stages and the temperature of each stage shall be defined by subsequent adding to the $T_K$ temperature the difference in the temperatures a the nearest stages until the strain temperature exceeds or is getting equal to the T* temperature. The deformation at each heating and deforming stage is processed by strain e not less than 0.6. The heating of the stock or ingot at each following stage is provided to the temperature which does not exceed the strain temperature at the previous stage.

The invention for processing the titanium alloys into controlled homogeneous fine grained articles can also be accomplished if the difference of the stage temperature is determined in accordance with the curve d=f(T) in such a way that this difference allows reducing the grain size at each stage about 2 to 10 times. The deformation within each stage is provided with the total reduction of strain where $e \geqq [a\, Ig(\sqrt{d_n}+1)]\, T_M/T_n$, where $d_n$ is the grain size before the beginning of n-stage, $T_n$ is the strain temperature at n-stage in K degrees, $T_M$ is the melting temperature of the stock material in K degrees, and "a" is the coefficient which is a=1 at $d_n \geqq 10$; a=1.5 at 1 $\mu$m<$d_n$<10 $\mu$m; a=2 at 0.5 $\mu$m$\leqq d_n$<1 $\mu$m; a=3 at $d_n \leqq 0.5$ $\mu$m. The deformation at each stage is provided at the stage temperature in several steps.

Depending on the shape of the stock or ingot, the deformation axis may rotate or turn the stock and change the deflection angle of between about 45–90°. The deformation is performed in the preferred strain rate range of about $10^{-4}$–$10^{-2}$ $sec^{-1}$. The deformation temperature should be corrected by multiplying a coefficient dependent on a semi-finished product volume. This coefficient is 0.98 for the volume up to 1 $dm^3$, 0.97 for the volume from 1 to 10 $dm^3$, and 0.95 for the volume greater than 10 $dm^3$. It should be noted that as the strain rate increases, the coefficient becomes a more important factor in the processing of the titanium alloys.

The stock with the original beta-transformed grain size greater than 2000 micrometers must be worked (deformed) before the first heat and deforming stage at a temperature higher than the polymorphous transformation temperature, such that $T_{CPT}$+10–50° C. The obtained grain size should be considered as the original grain size during the selection of the region of the main working.

Before the first heat and deforming stage the stock with original beta-transformed grain size greater than 2000 micrometers must be deformed with a reduction of 0.3 and strain rate in the range of $10^{-2}$–$10^{3}$ $sec^{-1}$ at the temperature higher than $T_{CPT}$–10–50° C. and with subsequent heating up to $T_{CPT}$+20–70° C. and cooled down to room temperature at the rate of about 5–100° C./sec.

The stock at least after the first strain stage should be cooled down to room temperature at the rate of about 5–100° C./sec. The thermocycle treating should be carried out in the temperature range from about 500° C. to $T_{CPT}$ with the number of cycles from 1 to 5 before deforming. This may not be needed and depends on the grain size of the titanium alloy stock. Also, the stock may be deformed in tools preheated to the temperature of about 10–50° C. higher than the heating temperature of the worked alloy. This is an optional step.

When a titanium bar is being processed and rotated around a single axis, the amount of steps of deforming may be chosen to be four or more at the final heat and deforming stage in additional to that the turning of the axis of deformation must be provided in a single plane.

The forming of semi-finished products of different shapes from the stocks with prepared microstructures can be accomplished by forming them at a temperature not lower than the strain temperature of the stock at the final heat and deforming stage of the stock material. In addition to this, the following is also recommended: forming (shaping) must be done under superplasticity conditions. Local deformation must be used.

The problem of making semi-finished products of unlimited sizes with micro-($\leqq$15 micrometers) and submicro-crystalline ($\leqq$1 micrometer) structures can be achieved by tightly setting a block of stocks or semi-finished products, and carrying out the block upsetting at the strain rate of about $10^{-4}$–$10^{-2}$ $sec^{-1}$ and the true-strain not less than 0.2 within the temperature range from 400° C. to $T_{CPT}$, where the upsetting temperature at the finishing stage is chosen to be not less than the strain temperature of the stock or semi-finished product with the coarsest grain size. In the case of upsetting of blocks of stocks or semi-finished products from alloys with different chemical compositions, (and therefore, with different strain temperatures at the final stage of stock working), the upsetting temperature must be not lower than the highest one of any of them.

Another aspect is to set up a block of at least two stocks or semi-finished products, and place between them the layer from the same material with grain size (d) by an order of magnitude less than what is in the stocks or semi-products. The layer thickness should be not less than 10 d. The upsetting of the block must be carried out at the strain rate of $10^{-5}$–$10^{-1}$ $sec^{-1}$, at 0.2 the true strain, in the temperature range from 400° C. to $T_{CPT}$, and where, the upsetting temperature is chosen to be not lower than the temperature at the final stage of working at which the grain size of the layer was obtained.

The essence of the invention is based on the fact that the uniform fine-grained microstructure with required grain size up to submicro-crystalline grains is formed as the result of the process of dynamic recrystallization over the wide temperature range of 400° C.–$T_{CPT}$. At the temperatures lower than 400° C., the dynamic recrystallization of titanium and its alloys is difficult due to low diffusion mobility of atoms. Also, the dynamic recrystallization at those lower temperatures can not be carried out practically by the use of conventional equipment. At the higher temperatures unacceptable grain coarsing, not only during working but also at its end, will take place.

It is necessary to determine the relation of recrystallized grain size to alloy strain temperature d=f(T). The obtained relation is true for the alloy of given chemical composition, and does not depend on the starting microstructure of the stock. The effect of the starting microstructure is taking into account by the introduction of calculated recrystallized grain size (d*), and corresponding to (d*), the T* strain temperature in the ratio d=f(T). The value d* can be determined in accordance with the $Ig(d_o/d^*)$=about 2.4–2.6, obtained experimentally for the titanium alloys with the beta-stabilization coefficient $K_B$<1.4, or $Ig(d_o/d^*)$=about 1.8–2 for the alloys with $K_B \geqq 1.4$, where $d_o$ is the grain size of the initial stock. In accordance with the above-mentioned relation, the T* temperature can be considered in a range of temperatures, and T* depends on the initial grain size ($d_o$) and increases with the initial grain size to about the temperature of the complete polymorphous transformation.

The T* temperature divides the specified temperature range (400° C.–$T_{CPT}$) into two zones: $T_{CPT}$–T* and T*−400° C. Within the first zone, including the T* temperature, working is processed in one step. Within the second zone, the stock is worked for more than one heat and deforming stage, with lowering of the temperature. This is caused by the fact that the technological plasticity of titanium alloys significantly depends on the microstructure, which is why at each previous heat and deforming stage it is necessary to obtain the microstructure with the proper grain size that achieves the necessary level of technological plasticity at the subsequent stage.

In order to get the microstructure with the required grain size ($d_K$) in the given alloy stock with the known starting grain size ($d_o$), it is necessary to determine the working temperature ($T_K$) which provides the formation of that required grain size as well as the temperature T* in accordance with the curve d=f(T). The one or more stages of working must be determined depending on which temperature zone of the curve the $T_K$ is located. In the case when the working should be carried out at several stages, the amount of those stages and the stage temperatures is chosen as follows: by adding step-by-step (sequentially) to the $T_K$ the regulated difference between stage temperatures until the strain temperature does not exceed (or is equal) to the $T_K$.

Values of true strain "e" are used, because the true strain is an equivalent for different loading, and it allows calculations of the required strain for processes like upsetting, drawing, extrusion, rolling, or torsion. A strain not less than 0.6 at each heat and deforming stage provides a dynamic recrystallization over the volume of the stock, and, therefore, results in an uniform fine grained microstructure. In the case of a multi stage strain, the heating at each stage must be done until the temperature does not exceed the strain temperature at the previous stage, otherwise the grain size coarsing will take place during heating.

The invention essence can be additionally developed and made precise by the usage of the following procedures. During the multi-stage working (more than one heat and deforming stage) it is advantageous to bring the temperature down at each stage by a value that provides about 2–10 times reduction in grain size. It was determined experimentally that the temperature difference between the stages must provide reduction of recrystallized grain sizes by not less than 2 times. A grain size reduction less than twice does not provide an economical process. Reduction in the grain size more than 10 times reduces the material such that it will be insufficient to complete the dynamic recrystallization at the next stage, and as a result, a non-uniform microstructure will be formed. At the lower strain temperatures, there is less material plasticity, and because of this, in the low part of the declared temperature range, the temperature decreasing steps must provide about 2–3 times reduction in the grain size, whereas at higher temperatures about 8–10 times can be used.

Non-uniformity of plastic deformation depends upon temperature and initial stock microstructure significantly, and reduces simultaneously with increasing strain temperature and decreasing grain size. That is why in order to obtain uniform microstructure with the required grain size (from different starting conditions, and strain temperatures) working must be carried out at different true strains. In connection with the last, the following relation was determined experimentally: "e"=[a $Ig(\sqrt{d_n}+1)]T_M/T_n$. That relation allows one to determine the required strain which is enough for getting the uniform microstructure, in accordance with the temperature and grain size at a stage.

By usage of conventional tools, in particular of flat dies, at strain about 0.6, there could exist a region of undeformed metal, typically a cone-shaped zone in a stock; the volume fraction of cone-shaped zone increases while the temperature decreases. Moreover, the required strain (determined at a stage in accordance with the temperature and the grain size) can exceed the value 0.6 in such a degree, that it is impossible to carry out that strain by a single pass. In such a case, the heat and deforming stage is performed in more than one step or pass, and each step or pass should be performed at the stage strain temperature. After each pass it is recommended to turn the axes of deformation through 45 and 90° to eliminate the cone-shaped zones formed at the previous stages or passes. Working of the stock at each pass is carried out at not less than 0.1 strain and not more than 0.5 strain. At the lower strains, conditions for the development of the dynamic recrystallization will not be generated. The restriction of the upper strain level is caused by the loss of mechanical stability of the stock at a following pass after a turn of axes of the strain. This allows achievement of a required strain, to work through the cone-shaped zones, and to get structural uniformity without any metallographic texture.

Decreasing of a strain rate is one of the ways to improve the technological plasticity (hot ductility), and in consequence of that, of strain uniformity. It is recommended to carry out the working or deforming at strain rates in the range of about $10^{-4}$–$10^{-2}$ $sec^{-1}$. Dynamic recrystallization in that range can result in superplastic metal flowing, depending on the initial state of material, and additionally to increase or improve the microstructure uniformity of the processed article.

Titanium alloys have low thermal conductivity. Therefore, during the working process, the temperature of the central area of a massive stock always is higher compared with that of peripheral areas, because of strain heating and insufficient transmission of heat in the stock central area. As a result, a coarse grain size can be formed in the center area of a massive stock. That is why in this invention the heating temperature is adjusted (depending on the stock size): multiplying the experimentally determined coefficients. In this case the difference in grain sizes over the stock volume is eliminated by heating during which the grains in the peripheral areas of the stock are getting coarser.

Titanium alloys with the size of beta-transformed grains more than 2000 micrometers have low hot ductility (low technological plasticity) at temperatures below $T_{CPT}$. In order to increase the uniformity of the alloy microstructure, the total strain must be increased by usage of multi-passes working at a stage. Moreover, those titanium alloys have the T* near the $T_{CPT}$, therefore, it is expedient to provide a pre-working procedure of the titanium alloys with the size of beta-transformed grains more than 2000 micrometers before the main working process. This preliminary working can be carried out at about 30–50° C. below $T_{CPT}$, a strain not less than 0.3, and a strain rate in the range of about $10^{-2}$–$10^{1}$ $sec^{-1}$ with subsequent annealing at temperature of $T_{CPT}$+20–70° C. These conditions allow to refine the initial microstructure, and, therefore, to make subsequent working easy, and as well, significantly to expend the temperature range, within which working is done at one stage. By choosing the parameters of main working, the grain size obtained by preliminary working should be considered as the initial one.

Increasing of the degree of laminas dispersion of double-phase titanium alloys contributes increasing of hot ductility and homogeneity of its strain because the thinner laminas the easier transformation of them into equaxed grains. Increasing of the degree of laminas dispersion is possible due to processes of heating up to the temperature above $T_{CPT}$ and subsequent controlled cooling. The usage of the described above method before the first heat and deforming stage (as well as between stages or the passes at a stage) is especially effective for obtaining of the microstructure with grain sizes less than 1 micrometer.

Providing of a preliminary thermocycling treatment within the range of about 500° C.–$T_{CPT}$ before strain, results a decrease of grain size, and an increase of dislocation density within grains caused by phase and heat stresses. This leads further during subsequent strain to make recrystallization easier with an uniform microstructure.

The main reason of the formation of a cone-shaped zone is high contact friction between the stock and the die (forging tools) in the contact zone. Usually high temperature lubricants, such as glass enamel, are used to reduce the friction. However, the stock sticking to the surface of the tools can take place because of the lubricant loss. The loss makes the working at several stages with axis changing difficult. In order to reduce the friction impact, and as a result, to decrease the volume fraction of the cone-shaped zones, it is recommended to heat the press tools up to a temperature of about 10–50° C. more than the stock temperature.

In order to produce a stock shape closer to the net-shape of the semi-finished product, the method includes selections of sequences of the stock turns during multi-pass strain at the finish stage. For example, to make a bar at the finishing stage of working, the turn of deformation axis between passes is carried out at one plane, and the number of passes should not be less than four.

The shaping of the semi-finished product from the stock with specified microstructure should be done at a temperature not below the strain temperature of the stock at the finishing stage. Otherwise, the coarsing of grains obtained at the preliminary working will take place. To obtain complicated shaped articles, the article should be treated to about $T_K$ or a little higher to increase the ductility of the material. The temperature should be at a temperature sufficient to increase the ductility without substantially changing the final grain size. Moreover, strain rate for shaping can be chosen in such a way to ensure superplastic conditions of deformation. This additionally improves the microstructure uniformity, and achieves a high level of mechanical properties after a final heat-treatment.

The technological conditions of achieving a homogeneous fine grain microstructure in unlimited size or large semi-finished products can be simplified by building up (gathering) a block in a prearranged size (specified size) from small stocks, and subsequently applying controlled strain of that block (for example, by upsetting) within the temperature range of 400° C.–$T_{CPT}$, at strain rates of about $10^{-5}$–$10^{-1}$ $sec^{-1}$, at not less than 0.2 strain. The specific block strain temperature must not be chosen below the strain temperature of stocks at the final stage. The described above working parameters insure superplastic flow conditions during the deformation of the block. The fundamental mechanism of superplastic deformation is grain boundary slipping (GBS), e.g., turn and slipping displacement of adjoining grains relatively to each other. GBS development during the block deformation allows to get a solid state joining of small stocks, moreover, at 0.2 and greater strain, the block becomes monolithic, and the boundary lines between the stocks that formed the block, disappear completely. This is achieved due to elimination of all possible pores in the joining area of the stocks by grain motion resulting from GBS. No less than 0.2 strain is required for stable superplastic deformation with maximum development of the GBT mechanism. Under such conditions the formation of high-grade solid state joining can be guaranteed. The semi-finished stocks worked by described above method can be used further as initial stocks to make larger semi-finished products.

The requirements in physical, mechanical or service characteristics for different areas of the same large section products, for example, turbine disks for aircraft engines, can vary significantly. The assembly and subsequent deformation of stocks from alloys with different chemical composition, consequently, with different strain temperatures at the final working heat and deforming stage, may be considered like the method of making large section part. The assembled block has to be deformed at the temperature not less than the highest strain temperature among joined stocks.

In some occasions it is technologically reasonable during the making of a semi-finished product, to place between the stocks layers from the stock material with grain size ten times finer than in the worked stocks. This allows to work semi-finished products at lower temperatures using in a number of cases only local heating of the zone where solid-state bonding is formed, and, therefore, to use lower power equipment. Usage of the layers provides localization of superplastic deformation within the solid-state bond formation, and, because of that, acceleration of the process of joint formation. The layer thickness should be not less than ten times the grain size.

The invention is illustrated by the following examples. Three alloys the chemical composition of which is shown in the table were worked.

TABLE I

| | | | Chemical content, wight %, (Ti-base) | | | | | | | | | | | |
|---|---|---|---|---|---|---|---|---|---|---|---|---|---|---|
| # | Type of Alloy | $T_{cpt}$ C.° | $K_b$ | Al | Mo | Zr | Sn | Fe | Si | Ti | O | C | N | H |
| A | BT8 | 1000 | 0.8 | 6.6 | 3.5 | 1.7 | — | 0.11 | 0.27 | Rem | 0.1 | .020 | 0.01 | 0.002 |
| B | BT1-00 | 900 | 0 | 0.2 | — | — | — | 0.15 | 0.07 | Rem | 0.1 | .050 | 0.02 | 0.005 |
| C | BT30 | 740 | 1.4 | — | 11 | 4.2 | 5.5 | 0.08 | 0.07 | Rem | 0.1 | .015 | 0.01 | 0.010 |

EXAMPLE 1

Samples (Ø 10×15 mm in size) cut from alloy A have been worked by upsetting in an universal dynamometer "INSTRON" at different temperatures in the range of 400–1000° C., at up to e=0.6 strain. In that case the temperature of 1000° C. is equal to $T_{CPT}$ temperature of the alloy. The size of the recrystallized grains should be determined in the central area of the deformed sample. The relation of recrystallized grain size to the alloy strain temperature is shown in FIG. 1.

Figure 2:
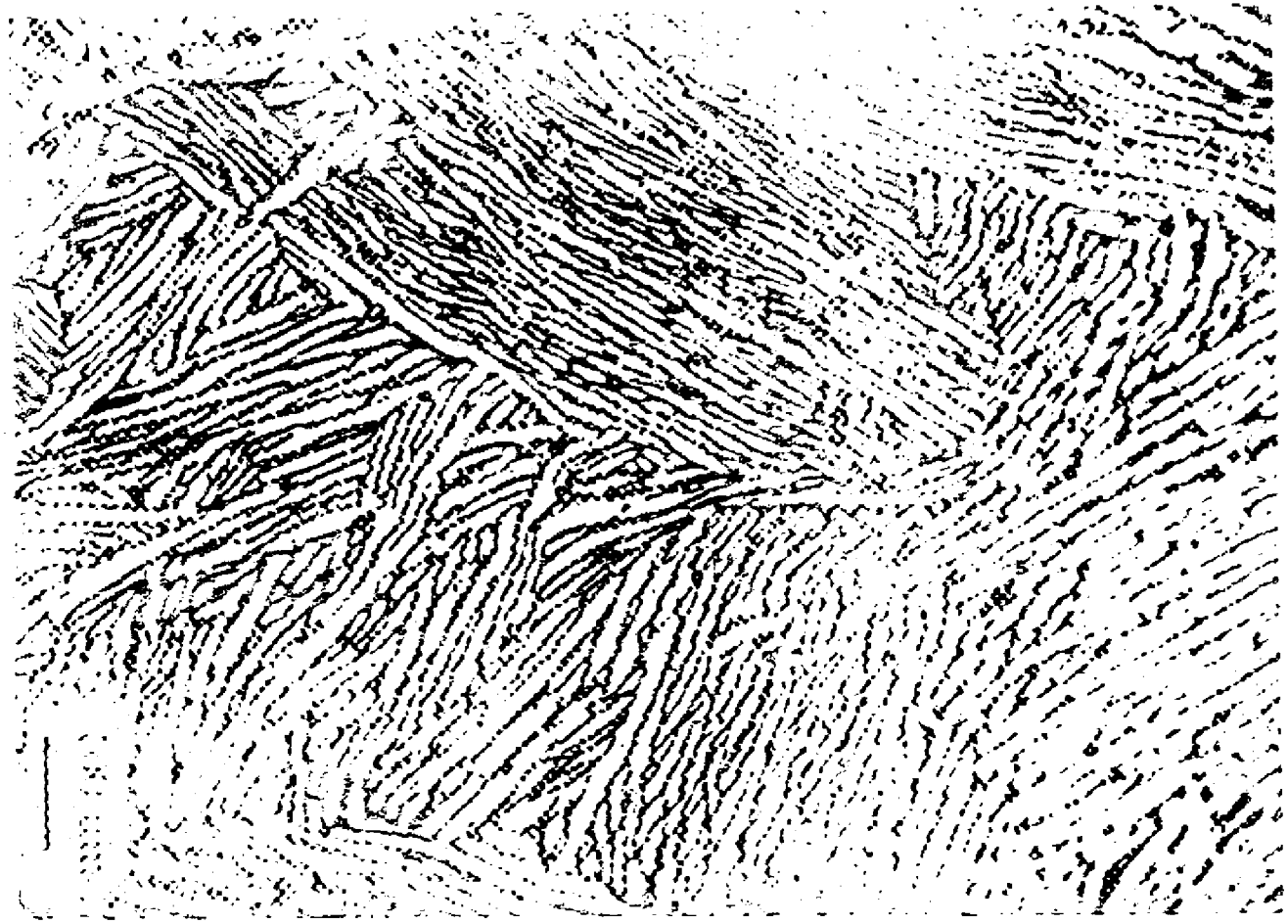
FIG. 2—Microstructure of titanium alloy BT8 in initial state.

The cylindrical stocks from A alloy (Ø 150×300 mm in size) have the size of beta-transformed grains of about 1000 micrometers (FIG. 2). After working, the microstructure with average grain size of $d_K$=5 micrometers is required. In accordance with the d=f(T) curve in FIG. 1, such grain size can be formed at temperature of TK=950° C. From the ratio $Ig(d_o/d^*)$=2.4–2.6 it can be determined that d*=2.5–4 um, and then from the d=f(T) relation, the corresponding temperature of T*=860–920° C. is determined. The temperature range of 400–1000° C. is divided by the T* temperature into two zones. Since the $T_K$ temperature at which the required grain size can be obtained is more than the T* temperature, the alloy is worked at the stage within the first temperature zone. The stock volume (Ø 150–300 mm) does not exceed of 10 $dm^3$, thus, taking into account the correction factor of 0.97, the heating temperature will be of 925° C. The stock is placed into KS-500 resistor furnace. The heating time determined under condition that mm of diameter should be heated per minute will be minimum 150 minutes. After holding in the furnace, the stock is placed into an isothermal press tool, which open dies from superalloy KC6-Y, are heated in low-frequency inductor up to 950° C. The strain of the stock at the stage is carried out at the average rate of $7–10^{-4}$ $sec^{-1}$. According to the ratio $e \geqq [a\ Ig(\sqrt{d_n}+1)]T_M/T_n$, where $T_n$—strain temperature at n-stage about 1220° K deg., $T_M$—melting temperature of the stock material (about 1970° K deg., a=1) it can be determined that the required strain (e) should be not less than 2.45. In order to compose that total (e) strain from the working chart included, the following steps can be used:

height stock upsetting up to e=0.45;

the stock turn through 90° [thus, that the direction of applied load (strain axis) will be coincide with the location (direction) of the maximum stock size after the previous upsetting], and stock is upset at e=0.45;

the stock turn through 90° [thus, that the direction of applied load (strain axis) will be on the same plane on which strain axis was during the previous upsetting], and stock is upset at e=0.3;

upsetting in six passes at e=0.25 at each pass, and stock turn through 45° after each pass thus, that strain axis remains on the same plane.

Figure 3:
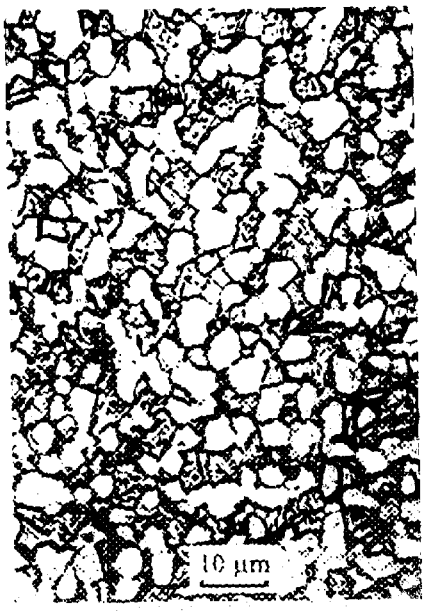
FIG. 3—Microstructure of titanium alloy BT8 after working at 950° C.

The final forming of the semi-finished stock into the rod of the required diameter by means of broaching at the temperature of 925° C. is carried out. The microstructure of the worked rod is shown in FIG. 3.

EXAMPLE 2

The stock (Ø 50×100 mm) from alloy A with the initial beta-transformed grain size of 2000 micrometere should be worked out in such a way that the microstructure with average grain size of $d_K$=0.2 micrometer will be obtained. It can be determined that $T_K$=650° C., d*=5–8 um and T*=950–990° C. Hence the strain temperature ($T_K$) is less than T*, the stock should be worked at several heat and deforming stages, the number of which is chosen in the next way: the grain size before the final stage should be chosen three times larger than the required final size, e.g., of 0.6 μm. The grain size of 0.6 μm in FIG. 1 correlates to the temperature of 730° C., which does not exceed the T* temperature, therefore, one more (additional) heat and deforming stage is required. For instance, take the grain size at that additional stage 10 times coarser than at the previous stage (before the final stage), e.g., 6 μm. The grain size 6 um in FIG. 1 correlates to the temperature of 975° C., which is within the range $T^*-T_{CPT}$, thus, this stage will be the first one. Therefore, the temperatures at the first, second and third stages will be 975, 730 and 650° C., respectively. The required strains at each of three stages determined taking into account the strain temperatures and initial grain sizes at each stage will be $e_1 \geqq 2.45$, $e_2 \geqq 1.5$, $e_3 \geqq 1.1$.

The thermocyclic treating which includes five repeated heatings up to 1000° C. and cooling to 500° C. should be carried out before the working of the alloy. The stock strain at each stage should be done at several passes (similar to example 1).

Figure 4:
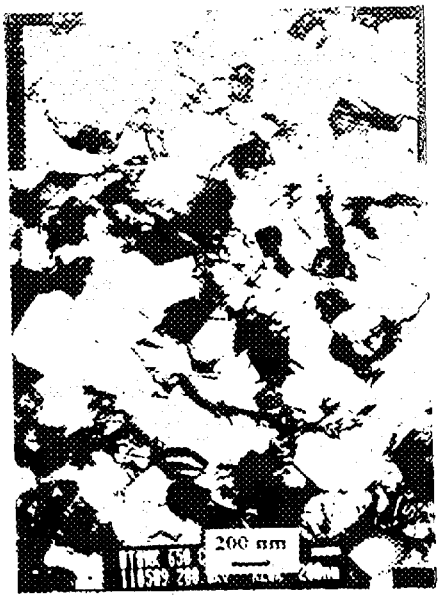
FIG. 4—Microstructure of titanium alloy BT8 after working at 650° C.

At the final stage the stock can be formed into a rod, the cross section of which is equilateral triangle, or square, or equilateral hexagon. The microstructure of the worked alloy is shown in FIG. 4.

EXAMPLE 3

The stock (Ø 200×400 mm) from A alloy with the initial beta-transformed grain size of 1000 μm should be worked out into a semi-finished disk product with the microstructure with average grain size of 3 μm. In this case, it is reasonable to refine the initial structure by carrying out strain at the temperature within the beta-phase area. For that purpose the stock is heated up to the temperature $T_{CPT}$+100° C. (1100° C.) and strained between flat dies in accordance with the following chart: upsetting at e=0.5 strain, and subsequent drawing up to the starting height. The stock temperature should be not decrease lower than $T_{CPT}$+100° C. (1100° C.), otherwise, intermediate heating should be done.

The described above treatment will result in the beta-transformed grain size of 1000 μm, and that grain size is used for definition of the T* temperature (required for achievement of the grain size 3 μm) and can be defined from the curves in FIG. 1. The heating temperature and required strain of the stock can be defined similar to Example 1. The die tools shall be heated up to the temperature 900° C. After described above structure preparation, the stock is first formed into the disk stock 350 mm in diameter. The final semi-finished disk product will be obtained by flattening under superplastisity conditions.

EXAMPLE 4

It is required to work a stock (100×100×200 mm) from alloy A with the initial beta-transformed grain size of 5000 μm into the stock of the same size and grain size of 2 μm. In order to reach that goal, it is expedient preliminarily to refine the initial grain structure. For this purpose the stock shall be heated up to the temperature $T_{CPT}$−40° C. (960° C.) and upset through the height on flat dies at e=0.25 strain and at strain rate of $10^{-2}$ $sec^{-1}$, and then it is formed by drawing into the initial size stock and heated up to the temperature of $T_{CPT}$+20° C. (1020° C.). The described treatment will result in the beta-transformed grain size of 500 μm, and the last is used for defining of the T* temperature (in that case, it will be 780–830° C.). The $T_K$ temperature required for achieving the grain size of 3 μm can be defined from the curves in FIG. 1. That is the temperature 830° C., e.g., within the range of $T^*-T_{CPT}$, therefore, the stock will be preliminary worked at one stage. The heating temperature and required strain of the stock can be defined similar to Example 1. The strain should be carried out at rate of $10^{-3}$ sec at six passes with turn of the stock through 90° after each pass in such way that upsetting (load direction) will coincide with the largest stock size. The strain at each stage is e=0.4.

At the final stage the stock can be under superplastic conditions at 830° C. into a rod, the cross section of which is equilateral triangle, or square, or equilateral hexagon.

EXAMPLE 5

It is require to work a stock (100×100×200 mm) from alloy A with the initial beta-transformed grain size of 5000 μm into the stock of the same size and grain size of 1.2 μm. In order to reach that goal, it is expedient preliminarily to fine the initial grain structure. For this purpose the stock shall be heated up to the temperature $T_{CPT}$+40° C. (960° C.) and upset through the height on flat dies at e=0.25 strain and at strain rate of $10^{-2}$ $sec^{-1}$, and then it is formed by drawing into the initial size stock and heated up to the temperature of $T_{CPT}$+20° C. (1020° C.) and then water cooled to room temperature. The described above treatment will result in the beta-transformed grain size of 500 μm, and the last is used for defining of the T* temperature (in that case, it will be 780–830° C.). The $T_K$ temperature required for achieving the grain size of 1.2 μm can be defined from the relation d=f(T) in FIG. 1. That is the temperature 790° C., e.g.,within the range of $T^*-T_{CPT}$, therefore, the stock will be preliminary worked at one stage. The heating temperature and required strain of the stock can be defined similar to Example 1. The strain should be carried out at rate of 10 sec.⁻ at six passes with turn of the stock through 90° after each pass in such way that upsetting (load direction) will coincide with the largest stock size. The strain at each pass is e=0.4.

EXAMPLE 6

Figure 5:
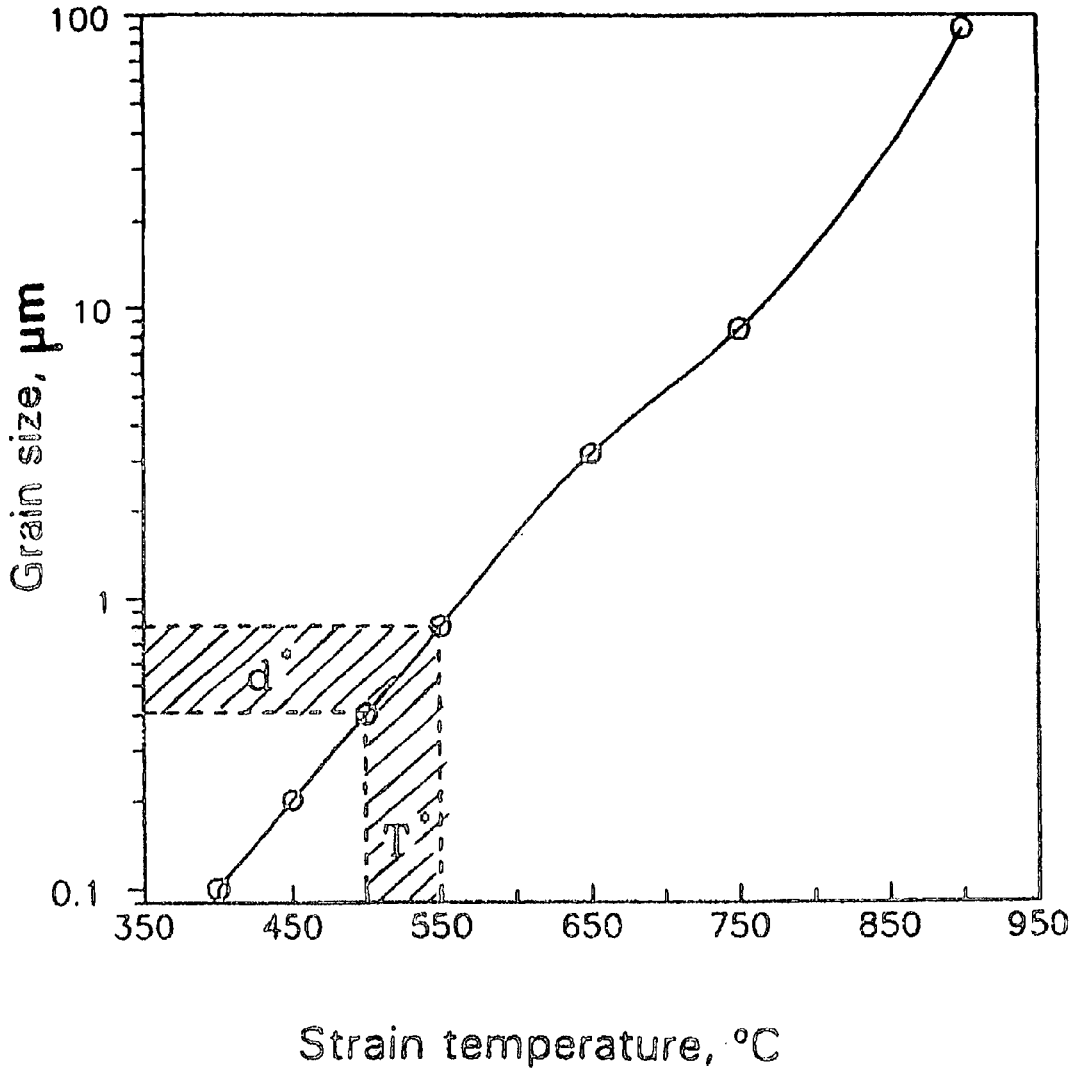
FIG. 5—Relation of recrystallized grain size to strain temperature for titanium alloy BT1-00.) at strain rate of $3–10^{-4}$ $sec^{-1}$ and at e=0.6 strain. The d* and T* areas (at $d_o$=200 mm) are shaded.

Samples (Ø 10×15 mm in size) cut from B alloy have been worked by upsetting in an universal dynamometer "INSTRON" at different temperatures in the range of 400–900° C., at up to e=0.6 strain. In that case the temperature of 900° C. is equal to $T_{CPT}$ temperature of the alloy. The size of recrystallized grains should be determined in the central area of the deformed sample. The relation of recrystallized grain size to the alloy strain temperature is shown in FIG. 5.

Figure 6:
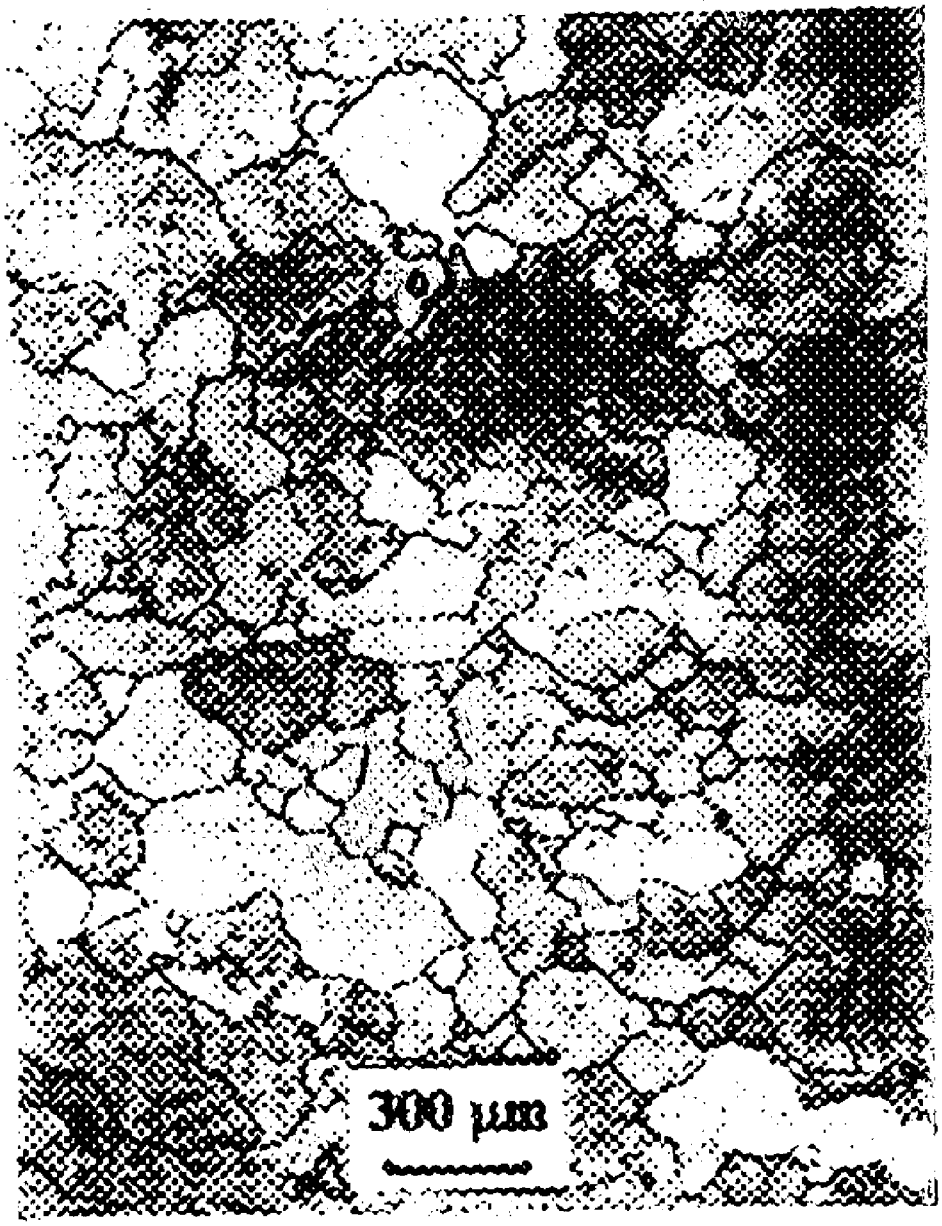
FIG. 6—Microstructure of titanium alloy BT1-00 in initial state.

It is necessary in the stock (Ø 50×100 mm) cut from alloy B with the initial grain size of 200 μm (FIG. 6) to obtain the microstructure with the average grain size of 5 micrometers. Determined values of the $T_K$ and T* temperatures are of 700° C. and 520–550° C., respectively. As the $T_K$ exceeds T*, so the stock is worked at one stage. The choice of the strain, heating temperature, and strain chart is carried out in the way illustrated in example 1.

Figure 7:
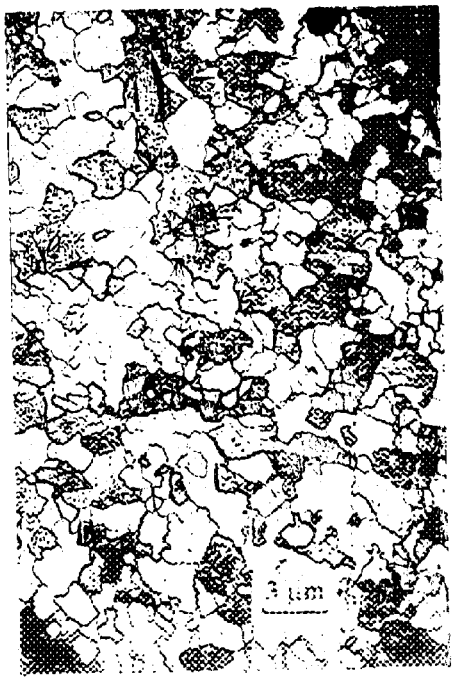
FIG. 7—Microstructure of titanium alloy BT1-00 after working at 670° C.

The final shape of the semi-finished product will be the square section parallelopiped 55 μm in side size. The microstructure of the worked stock after treating is shown in FIG. 7.

EXAMPLE 7

It is necessary in the alloy B stock (Ø 50×100 mm) with the initial grain size of 200 μm (FIG. 6) to obtain the microstructure with the average grain size of 0.1 μm. Determined values of the $T_K$ and T* temperatures are 400° C. and 520–550° C., respectively. As the $T_K$ temperature is less than T*, the stock will be worked at several stages, the number of which can be determined as follows. The grain size before the final stage is chosen twice larger (coarser) (e.g., 0.2 um). The grain size of 0.2 um correlates to the temperature 450° C. (see the curve in FIG. 5) which does not exceed T*, thus, one more stage is required. Let's choose the grain size at the previous before that stage 10 times coarser (e.g., 4 μm). The temperature correlates that grain size (FIG. 5) is 670° C.) within the zone of $T^*-T_{CPT}$). Thus, the stock should be worked at four stages, and the temperature at each stage are 670, 500, 450 and 700° C. The strain at each stage can be determined taking into account the strain temperature at the stage and the initial grain size before working at each stage. The stock at each stage is deformed at several passes similar to that in example 1.

Figure 8:
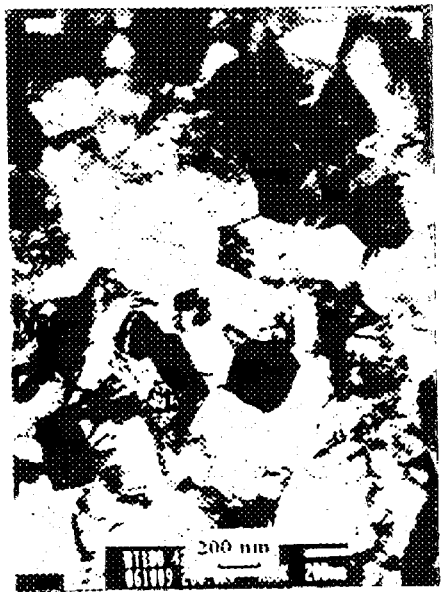
FIG. 8—Microstructure of titanium alloy BT1-00 after working at 400° C.

At the final stage the stock can be formed into a rod, the cross section of which is equilateral triangle, or square, or equilateral hexagon. The microstructure of the worked alloy is shown in FIG. 8.

EXAMPLE 8

Figure 9:
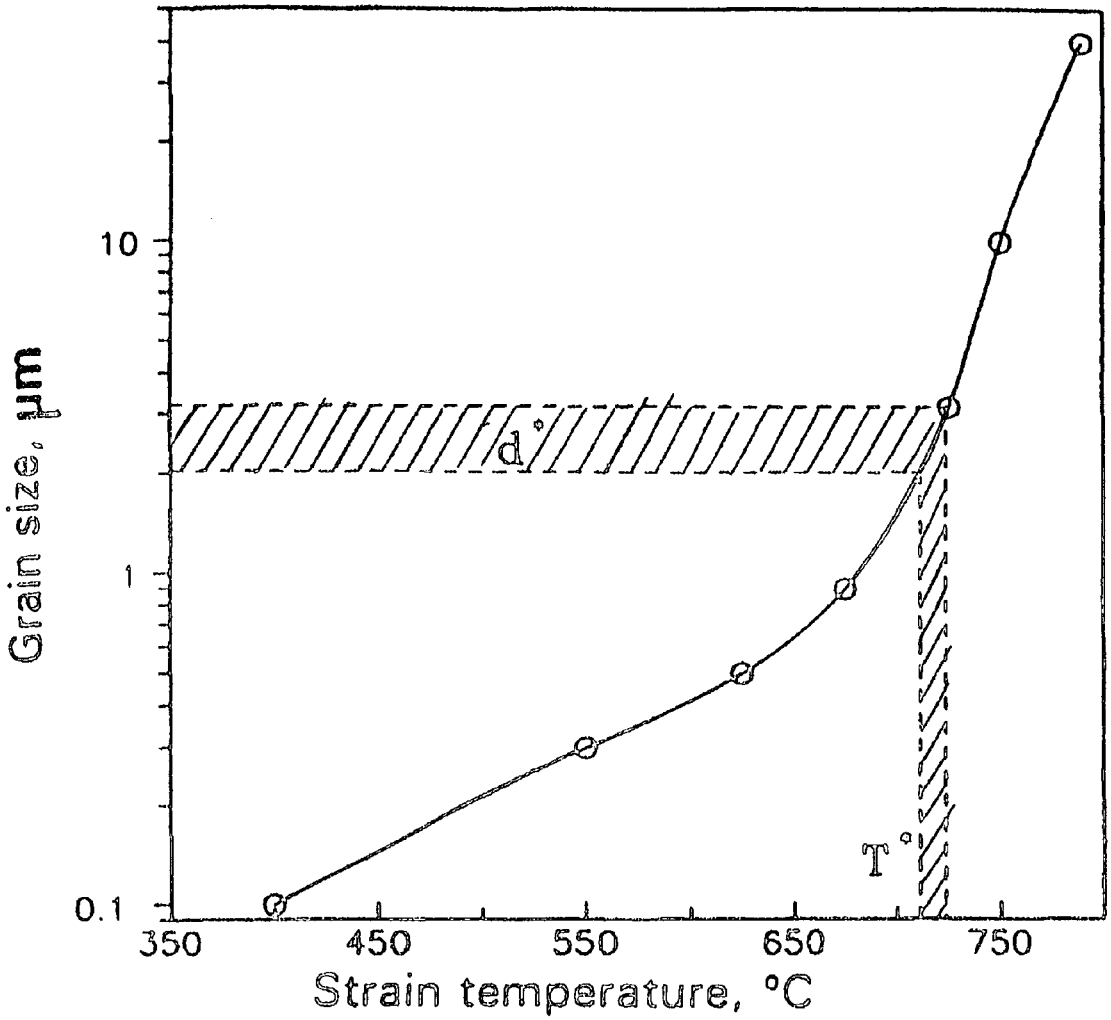
FIG. 9—Relation of recrystallized grain size to strain temperature for titanium alloy BT30 at strain rate of $3–10^{-4}$ $sec^{-1}$ and at e=0.6 strain. The d* and T* areas (at $d_o$=200 mm) are shaded.

Samples (Ø 10×15 mm in size) cut from alloy C sample have been worked by upsetting in an universal dynamometer "INSTRON" at different temperatures in the range of 400–740° C., at up to e=0.6 strain. In that case the temperature of 740° C. is equal to $T_{CPT}$ temperature of the alloy. The size of recrystallized grains should be determined in the central area of the deformed sample. The relation of recrystallized grain size to the alloy strain temperature is shown in FIG. 9.

Figure 10:
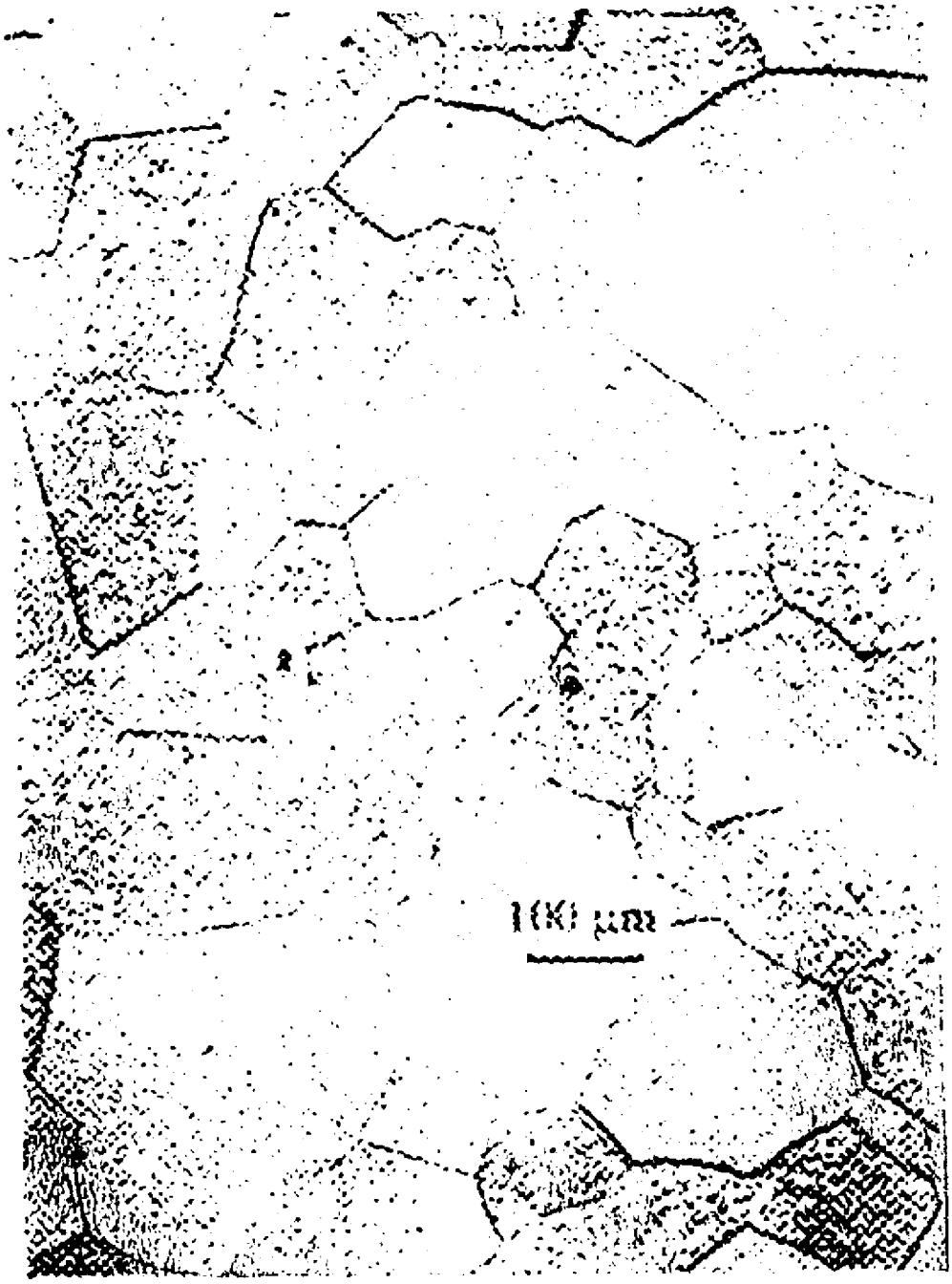
FIG. 10—Microstructure of titanium alloy BT30 in initial state.
Figure 11:
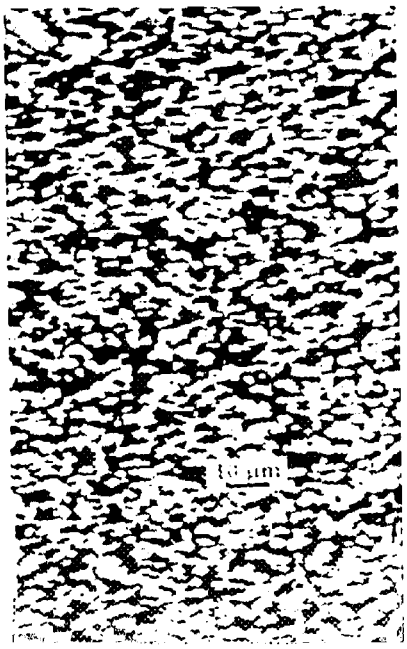
FIG. 11—Microstructure of titanium alloy BT30 after working at 740° C.

It is necessary in the alloy C stock (Ø 50×100 mm) with the initial grain size of 200 μm (FIG. 10) to obtain the microstructure with the average grain size of 5 μm. Determined values of the $T_K$ and T* temperatures are of 740° C. and 710–725° C., respectively. As the $T_K$ exceeds T*, and it is equal to $T_{CPT}$, so the stock is worked at one stage at the temperature of 740° C. The choice of the strain, heating temperature, and strain chart is carried out in the way illustrated in example 1. The microstructure of the worked stock is shown in FIG. 11.

EXAMPLE 9

Figure 12:
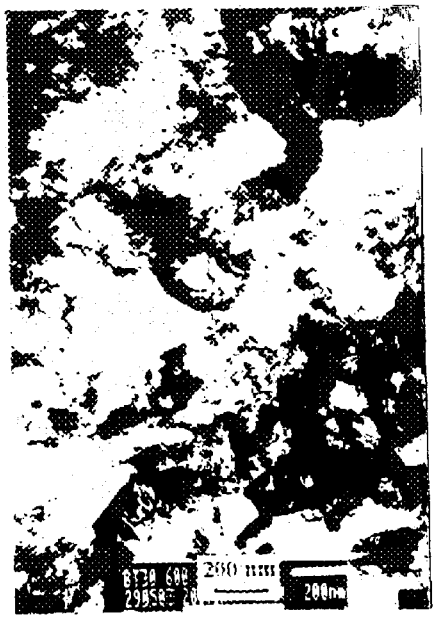
FIG. 12—Microstructure of titanium alloy BT30 (R.S.) after working at 550° C.

It is necessary in the alloy C stock (Ø 50×100 mm) with the initial grain size of 200 um (FIG. 10) to obtain the microstructure with the average grain size of 0.3 μm. Determined values of the $T_K$ and T* temperatures are of 550° C. and 710–725° C., respectively. As the $T_K$ is less than T*, the stock will be worked at several stages. The grain size before the final stage is chosen three time larger (0.6 um) than the required after the final stage. From the relation d=f(T) for alloy C (see FIG. 9) it is follows, that the grain size of 0.6 um correlates to the temperature of 645° C. At the following stage the grain size should be chosen 5 time larger (3 μm) than at the previous stage. That grain size (3 μm) correlates to the temperature of 730° C., which is between $T^*-T_{CPT}$, therefore, that stage will be the first one during working. The choice of the strain, heating temperature, and strain chart at each stage is carried out in the way illustrated in example 1. Moreover, after working at the first stage, the stock should be water cooled to room temperature. The microstructure of the worked stock is shown in FIG. 12.

EXAMPLE 10

It is necessary in the alloy C stock (Ø 50×100 mm with the initial grain size of 40 μm to obtain the microstructure with the average grain size of 0.5 μm. Determined values of the TK and T* temperatures are of 625° C. and 600–645° C., respectively. As the $T_K$ is within the range $T^*-T_{CPT}$, the stock will be worked at one stage. Before the main treatment, the stock is heated to the temperature of 760° C. and water cooled then to room temperature. The choice of the strain, heating temperature, and strain chart at each stage is carried out in the way illustrated in example 1.

EXAMPLE 11

It is necessary to obtain a semi-finished product with the average grain size of 5 μm from the alloy A stock (Ø

200×400 mm) with the beta-transformed grain size of 2000 μm. The values of the $T_K$ and T* temperatures determined from the curve in FIG. 1 are of 950° C. and 950–990° C., respectively. As the $T_K$ is within the range $T^*-T_{CPT}$, the stock will be worked at one stage. It can be defined that the required strain e should be not less than 2.7. In order to achieve that total strain, the next strain chart should be used:

stock heating up to the temperature of 95° C., stock deformation through the stock height at 0.25 strain, subsequent water cooling to room temperature;

stock heating up to the temperature of 950° C., stock deformation through the stock at five passes at 0.25 strain at each pass, and with the stock turn through 90° between the passes, and subsequent water cooling to room temperature;

repeat two previous paragraphs.

The rod 100 μm in diameter will be obtained after the final formation.

EXAMPLE 12

Cylindrical stocks 40 mm in height are cut from a rod (Ø 20 mm) from alloy B with submicrocrystalline structure with the average grain size of 0.1 μm. The stocks are heated in an electrical furnace in Argon inert atmosphere up to the temperature of 400° C. and upset at the average strain rate of $5-10^{-4}$ $sec^{-1}$ up to 10 mm in height in a large (100 tonne power) hydraulic press between plain dies preheated by an inductor up to 400° C. The stocks of a disk shape 40 mm in diameter will be produced. The grain size in the disk stocks retain of 0.1 μm. The disk stocks are machined to 38 mm in diameter. The upper and bottom surfaces of the disk stocks are being polished (is from each surface the layer not less than 0.5 mm has been deleted). During the mechanical treatments, the heating of the surface of the worked disk stock must not exceed 50° C. The polished surfaces are washed, dried and degreased. Then the block in the form of a cylinder 38 mm in diameter and 81 mm in height is set up from nine stocks 38 mm in diameter and 9 mm in height placed one over another coaxially. In order to fix the assembled block and to protect the inner contact surfaces of the stocks from oxidation, laser welding must be performed to the depth not more than 0.3 mm along the ring line of the stock joint.

The stocks block is heated in an electrical furnace in Argon inert atmosphere up to the temperature of 400° C. and upset at the average strain rate of $5-10^{-4}$ $sec^{-1}$ up to 10 mm in height in a large (100 tonne power) hydraulic press between simple (plain) dies preheated by an inductor up to 400° C. The semifinished product 108 mm in diameter and 10 mm in height will be obtained. The grain size in the disk stocks remains 0.1 um over the whole volume. Porosity in the zone of solid-phase joining is not revealed by metallography.

Using the process which is analogous to described above, a disk stock with submicrocrystalline microstructure and practically of any size can be manufactured making use of industry heating and forging equipment.

EXAMPLE 13

Cylindrical stocks 60 mm in height are cut from a rod (Ø 30 mm) from alloy A with submicrocrystalline structure with the average grain size of 0.4 μm. The stocks are heated in an electrical furnace in Argon-inert atmosphere up to the temperature of 700° C. and upset at the average strain rate of $5-10^{-4}$ $sec^{-1}$ up to 10 mm in height in a large (100 tonne power) hydraulic press between simple dies preheated by an inductor up to 700° C. The stocks of a disk shape about 74 mm in diameter and 10 mm in height will be produced. The grain size in the disk stocks remains of 0.4 μm. The disk stocks are machined to 72 mm in diameter. The upper and bottom surfaces of the disk stocks are polished (from each surface the layer not less than 0.5 mm has been removed) and made parallel. During the mechanical treatments, the heating of the surface of the worked disk stock must is not exceed 50° C. The polished surfaces are washed, dried and degreased. Then the block in the form of a cylinder 72 mm in diameter and 144 mm in height is set up from 16 stocks, 72 mm in diameter and 9 mm in height placed one over another coaxially. In order to fix the assembled block and to protect the inner contact surfaces of the stocks from oxidation, laser welding must be performed to the depth not more than 0.3 mm along the ring line of the stock joint.

The stocks block is heated in an electrical furnace in Argon-inert atmosphere up to the temperature of 700° C. and upset at the average strain rate of $5-10^{-4}$ $sec^{-1}$ up to 20 mm in height in a large (100 tonne power) hydraulic press between simple dies preheated by an inductor up to 700° C. The semifinished product 192 mm in diameter and 20 mm in height will be produced. The grain size in the disk stocks remains of 0.4 um over the whole volume. Porosity in the zone of solid-phase joining is not revealed by metallography.

Using the process which is analogous to above, a disk stock with submicrocrystalline microstructure and practically of any size required for development can be manufactured using industry heating and forging equipment.

EXAMPLE 14

Cylindrical stocks 100 mm in height are cut from a rod (Ø 50 mm) from alloy C with submicrocrystalline structure with the average grain size of 2.0 μm. The stocks are heated in an electrical furnace in Argon inert atmosphere up to the temperature of 700° C. and upset at the average strain rate of $5-10^{-4}$ $sec^{-1}$ up to 10 mm in height in a large (100 tonne power) hydraulic press between simple dies preheated by an inductor up to 700° C. The stocks of a disk shape about 158 mm in diameter and 10 mm in height will be produced. The grain size in the disk stocks remains of 2 μm. The disk stocks are machined to 156 mm in diameter. The upper and bottom surfaces of the disk stocks are being polished (from each surface the layer not less than 0.5 mm has been removed) and made parallel. During the mechanical treatments, the heating of the surface of the worked disk stock must not exceed 50° C. The polished surfaces are washed, dried and degreased. Then the block in the form of a cylinder 72 mm in diameter and 144 mm in height is set up from 16 stocks, 72 mm in diameter and 9 mm in height placed one over another coaxially. In order to fix the assembled block and to protect the inner contact surfaces of the stocks from oxidation, laser welding must be performed to the depth not more than 0.3 mm along the ring line of the stock joint.

The block unit in the form of a cylinder 156 mm in diameter and 306 mm in height is assembled from 34 stocks of 156 mm in diameter and 9 mm in height placed one over another coaxially. The block assembly is carried out directly on the lower flat die installed in a 1600 tonne power hydraulic press. After the end of the assembly the block is tightened by lowering of the upper flat die. The compression stress does not exceed 10 tonne. The dies together with the stocks block are heated in an inductor in argon atmosphere up to the temperature of 700° C. and then upset to 30 mm in height at the average rate of $5-10^{-4}$ $sec^{-1}$. The working surfaces of the dies from alloy KC6-Y (Russian Spec.) are preliminary coated with a thin layer of boron nitride in order to reduce friction coefficient and prevent sticking to the stock. Thus, the semi-finished product of about 498 mm. in diameter and 30 mm in height will be produced. The grain size in the disk stocks remains of 2 $\mu$m over the whole volume. Porosity in the zone of solid-phase joining is not revealed by metallography.

EXAMPLE 15

In the way similar to described in the above examples the cylindrical disk-type stock 300 mm in diameter and 50 mm in height is made of the Ø 20 mm rod from alloy A with microcrystalline microstructure. The strain temperature is 650° C. The ring stock 300 mm in outer diameter and 100 mm in inner diameter is made from that disk stock by cutting off its central area by a mechanical, or anode-mechanical, or arc cutting by fusion method.

The cylindrical stock Ø $100^{-0.15}$ mm and 50 mm in height are made of the Ø 20 mm rod from alloy C accordingly to described in previous examples manner. Moreover, the strain temperature is 650° C. Then the disk stock 300 mm in diameter and 50 mm in height is assembled from the alloy A ring stock and the alloy C stock by installing the alloy C stock into the center of the alloy A ring stock. Before assembling the contact flat surfaces of the block stock have to be polished (the heating of the surfaces must not exceed 50° C. during polishing). The polished surfaces are washed, dried and degreased. Then the block in the form of a cylinder 38 mm in diameter and 81 mm in height is set up from nine stocks 38 mm in diameter and 9 mm in height placed one over another coaxially. In order to fix the assembled block and to protect the inner contact surfaces of the stocks from oxidation, laser welding must be performed to the depth not more than 0.5 mm along the ring line of the stock joint.

The assembled block stock is installed on the bottom die in a 1600 tonne power hydraulic press and tightened by lowering of the upper flat die. The compression stress does not exceed 10 tonne. The dies together with the block stock are heated in an inductor in argon atmosphere up to the 650° C. and upset to of 25 mm in height at the average rate of $5\text{–}10^{-4}$ $sec^{-1}$. In order to reduce friction coefficient and prevent the dies working surfaces from sticking to the stock, the working surfaces of the dies are preliminary coated with a thin layer of boron nitride. As a result, the monolithic semi-finished disk stock 424 mm in diameter and 25 mm in height will be obtained. The central In order to eliminate the difference in grain size caused by the presence of submicrocrystalline microstructure of the sheet layers, the obtained block-stock is annealed at the temperature of 900° C. After that heat treatment the made rod stock 350 mm in diameter will have the uniform microstructure with the grain size of 3 $\mu$m.

Various modifications or equivalent functions and/or elements and/or structure and/or features and/or steps may be made by one skilled in the art to the disclosed invention without departing from the scope and extent of the invention.

What is claimed is:

1. A method for preparing an alpha or alpha-beta titanium alloy article having a desired substantially controlled homogeneous fine grain microstructure, comprising the steps of:

(1) starting with a titanium alloy article having an initial grain size ($d_o$);

(2) selecting a final grain size ($d_K$) to achieve in the titanium alloy article a homogenous fine grain size ($d_K$);

(3) plotting a curve of the relationship between a recrystallized grain size (d) for the titanium alloy on the y-axis versus a strain temperature (T) for the alloy on the x-axis, between a range of 400° C. and a temperature of complete polymorphous transformation ($T_{CPT}$), in accordance with the relationship d=f(T);

(4) locating an area T* on the strain temperature axis to divide the temperature axis into two zones comprising a first zone 400° C. to T*, and a second zone T* to $T_{CPT}$, where the T* is located by first calculating a corresponding recrystallization grain size (d*) on the y-axis, where d* is logarithmically related to the initial grain size $d_o$ by the ratio log ($d_o$/d*);

(5) further locating on the curve the final grain size ($d_K$) on the y-axis and then a corresponding strain temperature $T_K$ on the x-axis, wherein the strain temperature $T_K$ is determined according to the final grain size;

(6) determining heating and deforming stage and stages to process the article based on $T_K$, with respect to the curve and the position of $T_K$ to the curve, where for $T_{CPT}>T_K>T^*$, there is at least one heat and deforming stage to obtain the final grain size ($d_K$), and where $T_K<T^*$, the step of determining comprising determining at least two heat and deforming stages where each heat and deforming stage occurs for a sufficient amount of time to reduce the grain size of the titanium alloy article until the final grain size ($d_K$) is obtained, the number of stages and the temperature of each stage being defined by adding the difference in the temperatures at the nearest stages to the $T_K$ temperature until the strain temperature exceeds or is getting equal to the T* temperature, each deformation within each stage being provided with a reduction of strain where $e>[a \log(\sqrt{d_n}+1)]T_M/T_n$, where $d_n$ is the grain size before the beginning of n-stage, $T_n$ is the strain temperature at n-stage in K degrees, $T_M$ is the melting temperature of the stock material in K degrees, and "a" is the coefficient which is a=1 at $d_n>10$; a=1.5 at 1 $\mu$m<$d_n$<10 $\mu$m; a=2 at 0.5 $\mu$m<$d_n$<1 $\mu$m; a=3 at $d_n$<0.5 $\mu$m;

(7) then heating and deforming the titanium alloy article in accordance with the determined number of heat and deforming stages to achieve ($d_K$), where each heat and deforming stage has at least one heating and deforming step and one cooling step, where the heat and deforming stage occurs for a sufficient period of time to reduce the grain size of the titanium alloy article, and where the deformation of the titanium alloy article is in a substantially controlled manner during each heat and deforming stage at a rate of strain to achieve the desired grain size of the heat and deforming stage, where the true strain during the deformation is greater than or equal to 0.6 for each of the at least two heat and deforming stage, and where the one cooling step is conducted to temperatures below the heat and deforming stage temperature at a cooling rate for substantially maintaining the reduced grain size obtained during the heat and deforming stage; and (8) repeating paragraph (7) until the final substantially controlled homogeneous grain size ($d_K$) is obtained in the article having substantially homogeneous mechanical properties.

2. A method for preparing the titanium alloy article according to claim 1 wherein as a result of the method the desired final fine grain size is less than or equal to about 15 micrometers.

3. A method for preparing the titanium alloy article according to claim 1 where each of the at least two heat and deforming stage occurs for a sufficient amount of time to reduce the grain size of the titanium alloy article about 2 to 10 times until the final grain size ($d_K$), is obtained.

4. A method for preparing the titanium alloy article according to claim 1 where a deformation axis is turned 45–90° between steps.

5. A method for preparing the titanium alloy article according to claim 1 where the deformation is performed at a rate in the range of about $10^{-4}$ to $10^{-2}$ $sec^{-1}$.

6. A method for preparing the titanium alloy article according to claim 1 where the temperature of deformation is corrected by multiplying a coefficient dependent on an article volume where the coefficient is 0.98 for the volume up to 1 $dm^3$, 0.97 for the volume from 1 to 10 $dm^3$, and 0.95 for the volume greater than 10 $dm^3$.

7. A method for preparing the titanium alloy article according to claim 1 where the article with an original beta-transformed grain size greater than 2000 $\mu$m is deformed before the first heat and deforming stage at a temperature greater than $T_{CPT}$+10–50° C.

8. A method for preparing the titanium alloy article according to claim 1 where before the first heat and deforming stage, the article with original beta-transformed grain size greater than 2000 $\mu$m is deformed with a reduction of area of 0.3 and strain rate in a range of about $10^{-2}$ to $10^{-3}$ $sec^{-1}$ at a temperature greater than $T_{CPT}$−30–50° C. and with subsequent heating up to about $T_{CPT}$+20–70° C.

9. A method for preparing the titanium alloy article according to claim 1 where before the article is deformed, the article is heated up to about $T_{CPT}$+20–70° C. and cooled to room temperature at a rate of about 5–100° C./sec.

10. A method for preparing the titanium alloy article according to claim 1 where after the first heat and deforming stage, the article is cooled to room temperature at a rate of about 5–100° C./sec.

11. A method for preparing the titanium alloy article according to claim 1 where after each step in the heat and deforming stage, the article is cooled to room temperature at a rate of about 5–100° C./sec.

12. A method for preparing the titanium alloy article according to claim 1 where a thermocycle treatment is conducted in a temperature range of about 500° C. to $T_{CPT}$ for about 1 to 5 cycles before deforming.

13. A method for preparing the titanium alloy article according to claim 1 where tools for deforming the article are preheated to a temperature of about 10–50° C. higher than the heating temperature of the article for deforming.

14. A method for preparing the titanium alloy article according to claim 1 where the steps in the final heat and deforming stage is not less than four and an axis of deformation is in a single plane.

15. A method for preparing the titanium alloy article according to claim 1 where the method further comprises providing a semi-finished product of definite shape from the article at temperatures not lower than the heat temperature in the final heat and deforming stage.

16. A method for preparing the titanium alloy article according to claim 1 where the deforming is done under superplasticity conditions.

17. A method for preparing the titanium alloy article according to claim 1 where the method further comprises providing titanium alloys with different chemical compositions processed at different temperatures during the final heat and deforming stage.

18. A method for preparing the titanium alloy article according to claim 1 where the method further comprises providing a block of two or more articles, each block comprising a layer between the articles, the layer formed from the same article material with grain size (d) having an order of magnitude less than the grain size in the block.

* * * * *